US010677443B2

(12) United States Patent
Li et al.

(10) Patent No.: US 10,677,443 B2
(45) **Date of Patent: *Jun. 9, 2020**

(54) LAMP WITH INTERNALLY MOUNTED HEAT DISSIPATION DEVICE

(71) Applicant: LEDVANCE GMBH, Garching (DE)

(72) Inventors: Rencheng Li, Shenzhen (CN); Tingbiao Lan, Shenzhen (CN); Ran Lin, Shenzhen (CN); Zhian Li, Shenzhen (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/036,047

(22) Filed: Jul. 16, 2018

(65) Prior Publication Data

US 2018/0320877 A1 Nov. 8, 2018

Related U.S. Application Data

(63) Continuation of application No. 14/906,570, filed as application No. PCT/EP2014/065651 on Jul. 21, 2014, now Pat. No. 10,024,528.

(30) Foreign Application Priority Data

Jul. 22, 2013 (CN) ..... 2013 1 0308557

(51) Int. Cl.

| | |
|---|---|
| ***F21V 29/71*** | (2015.01) |
| ***F21V 17/00*** | (2006.01) |
| ***F21V 17/12*** | (2006.01) |
| ***F21V 23/00*** | (2015.01) |
| ***F21V 29/507*** | (2015.01) |
| ***F21V 29/89*** | (2015.01) |
| ***F21K 9/238*** | (2016.01) |
| *F21Y 105/10* | (2016.01) |

(Continued)

(52) U.S. Cl.

CPC ..... *F21V 29/713* (2015.01); *F21K 9/238* (2016.08); *F21V 17/005* (2013.01); *F21V 17/12* (2013.01); *F21V 23/006* (2013.01); *F21V 29/507* (2015.01); *F21V 29/89* (2015.01); *F21K 9/233* (2016.08); *F21Y 2105/10* (2016.08); *F21Y 2115/10* (2016.08)

(58) Field of Classification Search

CPC ..... F21V 23/006; F21V 29/713

See application file for complete search history.

(56) References Cited

U.S. PATENT DOCUMENTS

| | | | | |
|---|---|---|---|---|
| 7,575,346 | B1 | 8/2009 | Horng et al. | |
| 2008/0112170 | A1* | 5/2008 | Trott | F21S 8/02 362/311.06 |

(Continued)

FOREIGN PATENT DOCUMENTS

| | | | |
|---|---|---|---|
| EP | 2667090 | A1 | 11/2013 |
| WO | 2012099251 | A1 | 7/2012 |

*Primary Examiner* — Anh T Mai
*Assistant Examiner* — Michael Chiang
(74) *Attorney, Agent, or Firm* — Hayes Soloway PC

(57) ABSTRACT

Various embodiments may relate to an illuminating device including a light engine, a housing and a driver contained in the housing, wherein the illuminating device further includes a heat dissipation device disposed in the housing which includes a substrate for supporting the light engine and an insert ring in thermal-conductive contact with the substrate.

20 Claims, 2 Drawing Sheets

(51) Int. Cl.
*F21K 9/233* (2016.01)
*F21Y 115/10* (2016.01)

(56) References Cited

U.S. PATENT DOCUMENTS

| | | | | |
|---|---|---|---|---|
| 2010/0053950 | A1 | 3/2010 | Higuchi et al. | |
| 2011/0037368 | A1 | 2/2011 | Huang | |
| 2011/0109216 | A1* | 5/2011 | Kang | F21V 23/006 313/45 |
| 2011/0181167 | A1* | 7/2011 | Cho | F21V 5/04 313/46 |
| 2013/0088874 | A1* | 4/2013 | Huang | F21K 9/233 362/294 |
| 2013/0294085 | A1* | 11/2013 | Watanabe | B29C 45/14467 362/294 |

* cited by examiner

LAMP WITH INTERNALLY MOUNTED HEAT DISSIPATION DEVICE

CROSS-REFERENCE TO RELATED APPLICATIONS

The present application is a continuation of U.S. patent application Ser. No. 14/906,570, filed on Jan. 21, 2016, now issued as U.S. Pat. No. 10,024,528, and titled "Illuminating Device Having a Mounting Structure," which is a national stage entry according to 35 U.S.C. § 371 of PCT International Application No. PCT/EP2014/065651 filed on Jul. 21, 2014, which claims priority from Chinese Patent Application No. 201310308557.7, filed on Jul. 22, 2013. Each of these patent applications is incorporated by reference herein in its entirety.

TECHNICAL FIELD

Various embodiments relate to an illuminating device.

BACKGROUND

The LED technology has advantages such as high efficiency, energy saving and long lifetime and is currently widely used in the illumination technology. In an LED illuminating device, a heat dissipating performance is very important and directly affects a normal operation of the LED illuminating device, and especially there is a need to improve a heat dissipation effect between an LED light engine and a housing of the illuminating device. A heat dissipation device manufactured by a die casting process is usually used in, for example, a B- or P-type LED illuminating device, however, the heat dissipation device manufactured by the process has a large weight and has an increased cost due to cost required for machining and surface-treatment, and thus limits the application range of the illuminating device. Further, a heat dissipation device manufactured by a process such as insert molding is used, and manufacture cost of an illuminating device with the heat dissipation device becomes high because of the use of a die casting process during the machining of the heat dissipation device and machining cost in the insert molding.

SUMMARY

Various embodiments provide an illuminating device in which a heat dissipation device with a more simple design and structure is used so that the illuminating device is easily assembled and connected as a whole and has a reliable heat dissipation effect. Moreover, since an extrusion process is used, the heat dissipation device manufactured by the process has low cost, and a problem of high cost due to, for example, insert molding or die casting is avoided.

An illuminating device may include a light engine, a housing and a driver contained in the housing, wherein the illuminating device further includes a heat dissipation device disposed in the housing, the heat dissipation device includes a substrate for supporting the light engine and an insert ring in thermal-conductive contact with the substrate. As the heat dissipation device is disposed in the housing, a compact and simple structure of the illuminating device can be achieved so that the illuminating device can be designed to be more compact, and moreover, design of an additional heat dissipation device outside the housing is avoided, and the possibility of conducting and dissipating heat from the light engine and the driver is achieved by the respective two parts of the heat dissipation device.

In the illuminating device according to various embodiments, the substrate and the insert ring are formed separately. An effect of dissipating heat at different positions can be achieved by the heat dissipation device formed by separate members, and a heat dissipation area can be increased by the plate-shaped and ring-shaped designs to achieve the possibility of heat dissipation with high efficiency.

In various embodiments, the substrate is lap-jointed on the insert ring. With such design, the light engine and the driver which also serve as heat sources can be spatially and structurally separated from each other and subjected to heat dissipation through different heat conducting paths, and moreover, a compact and simple connection structure can be achieved so that the heat dissipation device is fixed in the housing and that the illuminating device is assembled more conveniently.

In various embodiments, the insert ring is disposed at a periphery of the substrate in a radial direction thereof. With such design, the insert ring provides the possibility of conducting heat in the radial direction and provides the possibility of surrounding the driver so that heat can be ultimately dissipated through, for example, the housing.

In various embodiments, the insert ring is disposed to surround part of the driver and disposed to be in thermal-conductive contact with the housing. Thus, the insert ring allows the possibility of dissipating heat from the driver in the circumferential direction, and since the insert ring has a ring-shaped design, the insert ring has a large heat dissipation surface area and can be conveniently mounted and fixed in the housing to achieve the possibility of ultimately dissipating heat through the housing and achieve a reliable heat dissipation effect.

In various embodiments, each of the substrate and the insert ring is disposed to have a foolproof structure. Such structural design allows the substrate and the insert ring to be mounted and fixed more easily according to design requirements during assembly of the illuminating device so that the whole illuminating device is assembled in a more convenient manner.

In various embodiments, the illuminating device further includes a heat conducting layer disposed between the substrate and the insert ring and between the insert ring and the housing. Such heat conducting layer provides an additional connecting action for a tolerance gap between the respective parts so that heat conduction between the respective parts can be performed smoothly to achieve a stable heat dissipation effect.

In various embodiments, the heat conducting layer is designed as a heat conductive oil or potting adhesive. The heat conductive oil or potting adhesive can achieve not only a close connection between the parts such as the substrate, the insert ring and the housing but also smooth heat conduction between the parts.

According to various embodiments, the substrate and the insert ring is respectively designed as an extrusion member. With such design, the heat dissipation device formed by the substrate and the insert ring can be machined and produced more easily and can be low in cost, and high efficiency of heat dissipation is ensured.

In various embodiments, each of the substrate and the insert ring is made of metal. Such material has a high efficient thermal conductivity and can be easily machined by extrusion to achieve a high-efficient heat dissipation effect of the resultant heat dissipation device.

In various embodiments, each of the substrate and the insert ring is made of aluminum. Such substrate and insert ring have a small mass and have a high thermal conductivity so that the heat dissipation device has a high-efficient heat dissipation effect.

According to various embodiments, the illuminating device further includes a holder disposed to hold, with the housing, the heat dissipation device therebetween. The holder provides further fixing of the heat dissipation device and ensures effective and firm mechanical connection between the respective parts of the illuminating device.

In various embodiments, the holder is connected in a form-fitting manner to the substrate. Such connection manner allows the possibility of reducing the whole volume of the illuminating device so that the whole structure of the illuminating device is more compact and simple, and moreover can achieve the effect of closely attaching the substrate to the light engine to ensure a high-efficient heat dissipation effect.

In various embodiments, the insert ring is arranged on an inner flange of the housing that protrudes inward to the substrate. With such design, the insert ring can be mounted and fixed in the housing, and a basis is provided for fixing and connection of the substrate which is lap-jointed to the insert ring.

In various embodiments, the holder includes first mounting holes, the housing has mounting poles that are provided with third mounting holes, and a fastening structure mounts the holder to the housing through the first mounting holes and the third mounting holes. Therefore, by the first and third mounting holes, the holder and other parts can be assembled more easily, and the possibility of firm connection between the respective parts of the illuminating device is ensured.

In various embodiments, the substrate includes second mounting holes allowing the fastening structure to pass through. This achieves the possibility of connecting the substrate to the housing by the second mounting holes and ensures that the heat dissipation device can be fixed in the illuminating device.

In various embodiments, the mounting poles are disposed in the housing and distributed in a circumferential direction of the housing. The mounting poles provide an effective manner of connecting and fixing the holder, the substrate and the insert ring to one another so that the plurality of parts can be fixed and connected together in the axial direction.

In various embodiments, the fastening structure is a bolt structure, and the first mounting holes and the third mounting holes are screw holes. Therefore, the plurality of parts of the illuminating device can be effectively connected and fixed in the axial direction in a simple manner by the bolt structure.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

Figure 1:
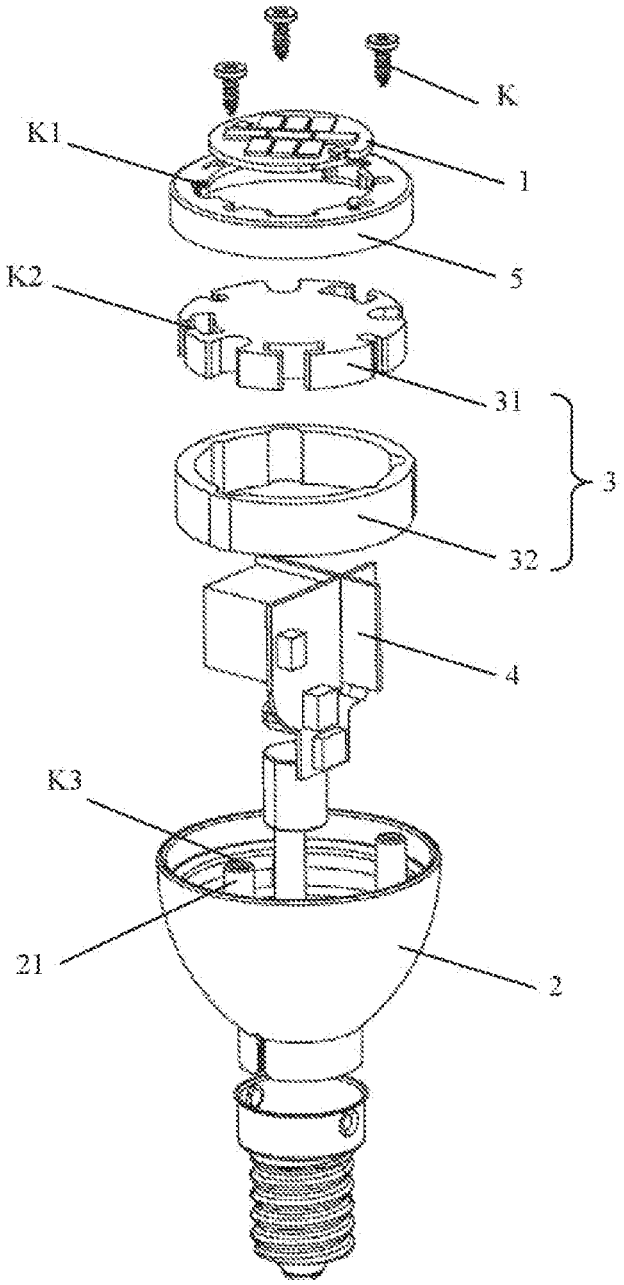
FIG. 1 is an exploded view of an illuminating device according to the present disclosure.

FIG. 1 illustrates an exploded view of an illuminating device 100 according to the present disclosure. The illuminating device 100 consists of a light engine 1, a holder 5, a heat dissipation device 3, a driver 4, and a housing 2 in this order in an axial directional thereof. The heat dissipation device 3 is designed according to the present disclosure as two separate parts independent of each other, i.e., a substrate 31 and an insert ring 32, the substrate 31 is located between the holder 5 and the insert ring 32 in the axial direction, and the heat dissipation device 3 is disposed as a whole between the holder 5 and the housing 2, thus the heat dissipation device 3 can be designed to be held by the holder 5 or clamped between the holder 5 and the housing 2 during assembly, which facilitates the formation of a simple and compact connection structure.

Moreover, according to the design of the present disclosure, the substrate 31 and the insert ring 32 are formed by an extrusion process and made of a material which is preferably aluminum, thus the heat dissipation device 3 has a high efficient thermal conductivity of an aluminum material, an effect of conducting and dissipating heat from the light engine 1 or the driver 4 with high efficiency can be achieved, and meanwhile a problem of high cost in machining and manufacture caused by using a process such as die casting or insert molding is avoided.

Specifically, a design of a foolproof structure is used in both the substrate 31 of the heat dissipation device 3 and the holder 5 according to the present disclosure, that is, it is ensured that the substrate 31 is inserted into the holder 5 from only one direction and fixedly connected to the holder 5 during connection of the substrate 31 to the holder 5. Further, the substrate 31 can be designed, for example, to have a shape matching that of the holder 5, and for example, as shown in FIG. 1, a plurality of tooth-like structures are designed in an outer circumferential direction of the substrate 31, and structures such as tooth grooves are designed in an inner circumferential direction of the holder 5 so that the substrate 31 can be inserted in and surrounded by the holder 5 by means of the structures so designed.

Moreover, the illuminating device 100 further includes a bolt structure K designed, for example, as screws, and the bolt structure K can further connect, as a fastening structure, the heat dissipation device 3 and the housing 2 through the holder 5. A plurality of first mounting holes K1 are designed in a circumferential direction of the holder 5, a plurality of second mounting holes K2 are disposed in a circumferential direction of the substrate 31, and a third mounting hole K3 is provided in each of a plurality of mounting poles 21 disposed in the housing 2. The mounting poles 21 are distributed in the housing 2 in a circumferential direction of the housing 2 and extend along an axial direction of the housing 2, three mounting poles 21 are designed as shown in FIG. 1, and the number of the mounting poles 21 can be of course determined based on the number of the first mounting holes K1 and the second mounting holes K2 respectively disposed in the holder 5 and the substrate 31 so as to ensure that the holder 5 and the substrate 31 can be finally connected to the housing 2 by screws sequentially through the first, second and third mounting holes K1, K2, K3. The mounting poles 21 disposed in the housing 2 can pass sequentially through the insert ring 32 and the second mounting holes K2 disposed in the circumferential direction of the substrate 31 when being assembled, thus a fixed mechanical connection between the holder 5 and heat dissipation device 3 and the housing 2 can be achieved only by allowing the screws K to pass sequentially through the first and second mounting holes and finally be screwed in the third mounting holes during mounting. In this way, edges at different positions of a circuit board of the light engine 1 can be, for example, clamped directly by the screws so as to be connected to a surface of the substrate 31, and moreover the substrate 31 and the insert ring 32 of the heat dissipation device 3 are clamped or held between the holder 5 and the housing 2, the substrate 31 is directly lap jointed to the insert ring 32 and is connected in thermal contact with the circumference of the insert ring 32, and the insert ring 32 and the housing 2 are connected in thermal contact with each other while being connected in direct contact. Furthermore, the driver 4 is partially surrounded by the insert ring 32, thereby providing an effect of, for example, dissipating heat from part of the driver 4 in the circumferential direction.

Figure 2:
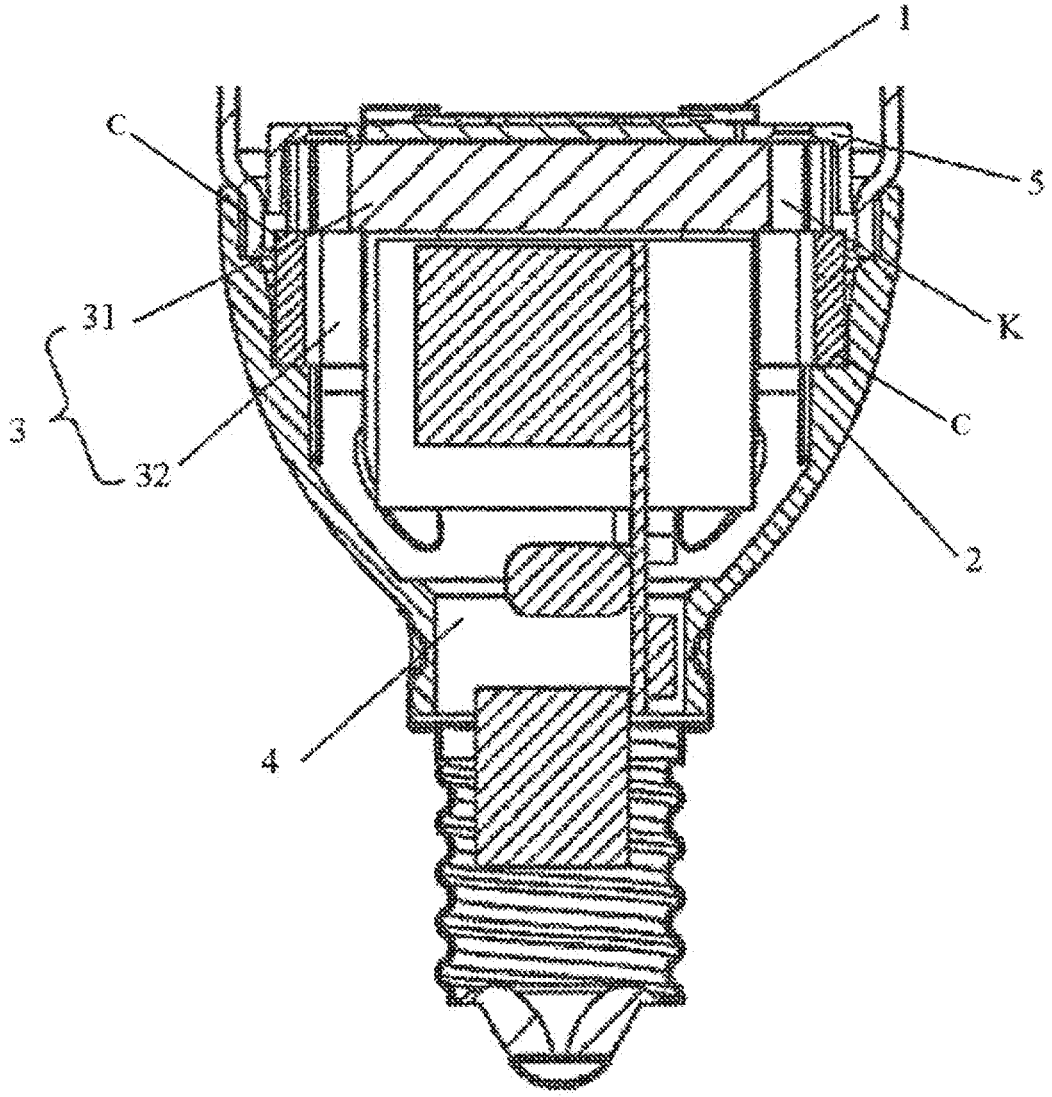
FIG. 2 is a sectional view of an assembled illuminating device according to the present disclosure.

During assembly, mounting and fixing of the whole illuminating device 100 can be achieved only by mounting the respective parts in this order in the axial direction as shown in FIG. 1. The illuminating device after assembly is shown in FIG. 2 which illustrates a sectional view of an assembled illuminating device according to the present disclosure. According to the design of the present disclosure, after the illuminating device 100 is assembled, the light engine 1 is fixed and mounted on the surface of the substrate 31 and attached to the substrate 31 so as to achieve absorption and conduction of heat from the light engine 1 by the substrate 1. The substrate 31 and the insert ring 32 forming the heat dissipation device 3 are located between the holder 5 and the housing 2 after assembled so that the heat dissipation device 3 can be wholly contained in the housing 2, and an opening end of the housing 2 is closed in the circumferential direction by the heat dissipation device 3 so that a cavity for accommodating the driver 4 is defined by both the heat dissipation device 3 and the housing 2, the purpose of dissipating heat from the driver 4 accommodated therein can be achieved by the heat dissipation device 3 and the housing 2, and further a more compact structure and a simple connection are achieved.

Furthermore, after manufacture, machining, assembly and connection, gaps due to tolerance are formed at joints between the respective parts, and a heat conducting layer C of, for example, a heat conductive oil or potting adhesive is disposed at these joints so as to ensure that heat conduction and heat dissipation between the respective parts are performed smoothly and efficiently, and for example, the heat conducting layer C is disposed both between the substrate 31 and the insert ring 32 and between the insert ring 32 and the housing 2 so that an effect of smoothly conducting and dissipating heat between these parts is ensured. The heat conducting layer C so designed can be, of course, also applied to other positions where heat is not conducted smoothly due to a tolerance gap so as to ensure that the illuminating device 100 as a whole has a good heat dissipation effect.

Moreover, the circuit board of the driver 4 can be designed to match the shape of the housing 2 so that after inserted in the housing 2, the driver 4 can be properly contained in the housing 2 and be partially surrounded by the insert ring 32 in the circumferential direction and covered by the substrate 31 in the axial direction after the illuminating device 100 is mounted, thus heat from the driver 4 can be conducted and dissipated directly through the housing 2 and also can be dissipated in the circumferential and axial directions by the insert ring 32 and the substrate 31.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lamp comprising:

a housing comprising a plurality of mounting poles, wherein the plurality of mounting poles includes a first plurality of mounting holes;

a heat dissipation device configured to be disposed wholly within the housing, wherein the heat dissipation device includes a second plurality of mounting holes; and a holder configured to hold a light source of the lamp, wherein the holder includes a third plurality of mounting holes;

wherein the heat dissipation device is further configured to be at least partially inserted into the holder; and wherein the first, second, and third pluralities of mounting holes align such that at least one fastening element inserted sequentially therethrough physically couples the holder and the heat dissipation device to the housing.

2. The lamp of claim 1, wherein the heat dissipation device comprises:

a first portion configured to have the light source mounted thereto; and a second portion configured to surround a driver of the lamp at least partially.

3. The lamp of claim 2, wherein the holder is configured to be connected in a form-fitting manner to the first portion of the heat dissipation device.

4. The lamp of claim 2, wherein the first portion of the heat dissipation device is configured to be inserted into the holder from only one direction.

5. The lamp of claim 2, wherein the first portion of the heat dissipation device is configured to be directly lap jointed to the second portion of the heat dissipation device.

6. The lamp of claim 2, wherein the first portion of the heat dissipation device comprises a substrate.

7. The lamp of claim 6, wherein the substrate is configured to cover the driver at least partially in an axial direction.

8. The lamp of claim 2, wherein the second portion of the heat dissipation device is configured to dissipate heat from the driver in a circumferential direction with respect to a longitudinal axis of the lamp.

9. The lamp of claim 2, wherein the second portion of the heat dissipation device comprises an insert ring.

10. The lamp of claim 9, wherein the insert ring is configured to surround the driver at least partially in a circumferential direction.

11. The lamp of claim 2, further comprising a heat conducting layer disposed at a gap between at least one of:

the first and second portions of the heat dissipation device; and the second portion of the heat dissipation device and the housing.

12. The lamp of claim 11, wherein the heat conducting layer comprises at least one of a heat-conductive oil and a potting material.

13. The lamp of claim 2, wherein the first portion of the heat dissipation device is configured to be inserted into the holder.

14. The lamp of claim 1, wherein the holder has a central aperture configured to have the light source reside therein.

15. The lamp of claim 1, wherein the housing has an open end and the heat dissipation device is configured to close off the open end in a circumferential direction when the heat dissipation device is disposed wholly within the housing.

16. The lamp of claim 1, wherein the heat dissipation device is configured to be held by the holder.

17. The lamp of claim 1, wherein the heat dissipation device is configured to be clamped between the holder and the housing.

18. The lamp of claim 1, wherein the plurality of mounting poles comprises three mounting poles arranged equidistantly with respect to one another within an interior of the housing.

19. A lamp comprising:

a housing comprising a plurality of mounting poles, wherein the plurality of mounting poles includes a first plurality of mounting holes;

a heat dissipation device configured to be disposed wholly within the housing, wherein the heat dissipation device includes a second plurality of mounting holes, and wherein the heat dissipation device comprises:

a first portion configured to have the light source mounted thereto, wherein the first portion comprises a substrate including a plurality of tooth-like structures formed in an outer circumferential direction thereof; and a second portion configured to surround a driver of the lamp at least partially; and a holder configured to hold a light source of the lamp, wherein the holder includes a third plurality of mounting holes, and wherein the holder includes a plurality of tooth grooves formed in an inner circumferential direction thereof and configured to receive the plurality of tooth-like structures when the substrate is inserted within the holder;

wherein the first, second, and third pluralities of mounting holes align such that at least one fastening element inserted sequentially therethrough physically couples the holder and the heat dissipation device to the housing.

20. A lamp comprising:

a housing comprising a plurality of mounting poles, wherein the plurality of mounting poles includes a first plurality of mounting holes;

a heat dissipation device configured to be disposed wholly within the housing, wherein the heat dissipation device includes a second plurality of mounting holes, and wherein the heat dissipation device comprises:

a first portion configured to have the light source mounted thereto, wherein the first portion comprises a substrate; and a second portion configured to surround a driver of the lamp at least partially; and a holder configured to hold a light source of the lamp, wherein the holder includes a third plurality of mounting holes;

wherein the first, second, and third pluralities of mounting holes align such that at least one fastening element inserted sequentially therethrough physically couples the holder and the heat dissipation device to the housing; and wherein the at least one fastening element clamps an edge of a circuit board of the light source directly onto the substrate.

* * * * *